US008833333B1

(12) United States Patent
Neal et al.

(10) Patent No.: US 8,833,333 B1
(45) Date of Patent: Sep. 16, 2014

(54) OIL SYSTEM FOR DIESEL ENGINES THAT OPERATE IN COLD ENVIRONMENTS

(76) Inventors: Kennieth Neal, Mesa, AZ (US); Gene Neal, Mesa, AZ (US)

( * ) Notice: Subject to any disclaimer, the term of this patent is extended or adjusted under 35 U.S.C. 154(b) by 207 days.

(21) Appl. No.: 13/417,760

(22) Filed: Mar. 12, 2012

Related U.S. Application Data

(60) Provisional application No. 61/464,868, filed on Mar. 10, 2011.

(51) Int. Cl.

| | |
|---|---|
| ***F01M 5/00*** | (2006.01) |
| ***B23P 6/00*** | (2006.01) |
| ***B21K 3/00*** | (2006.01) |
| ***F01M 11/03*** | (2006.01) |

(52) U.S. Cl.
USPC ..... 123/196 AB; 29/888.011; 184/104.3

(58) Field of Classification Search
USPC ..... 123/41.42, 196 R, 196 AB, 41.33; 184/6.5, 104.3; 29/888.011
See application file for complete search history.

(56) References Cited

U.S. PATENT DOCUMENTS

| | | | | |
|---|---|---|---|---|
| 4,027,643 | A * | 6/1977 | Feenan et al. | 123/196 AB |
| 4,190,198 | A * | 2/1980 | Casuga et al. | 236/34.5 |
| 5,746,170 | A * | 5/1998 | Moriya | 123/196 AB |
| 6,719,208 | B2 * | 4/2004 | Brown | 236/34.5 |
| 7,540,431 | B2 * | 6/2009 | Kozdras et al. | 236/34.5 |
| 8,141,790 | B2 * | 3/2012 | Sheppard | 236/34.5 |

FOREIGN PATENT DOCUMENTS

| | | | |
|---|---|---|---|
| DE | 3618794 | A1 * | 12/1987 |
| GB | 1595051 | A * | 8/1981 |
| RO | 108994 | B1 * | 10/1994 |

* cited by examiner

*Primary Examiner* — Noah Kamen
(74) *Attorney, Agent, or Firm* — John D. Titus

(57) ABSTRACT

An aftermarket modification for diesel engines that operate in cold environments particularly those using an air-to-liquid oil cooler. Engine oil can be routed to a filter and if the oil has not reached the desired operating temperature, a bypass module having a temperature element directs the oil past the cooler to return to the engine. Once the desired oil temperature is reached, the thermostatic element closes to direct oil through the cooler. A pressure bypass element can be incorporated into the bypass module. If the pressure differential between the inlet and outlet of the cooler exceeds a set point, a portion of the oil bypasses the cooler.

2 Claims, 5 Drawing Sheets

Configuration 1

Configuration 2

OIL SYSTEM FOR DIESEL ENGINES THAT OPERATE IN COLD ENVIRONMENTS

CROSS-REFERENCE TO RELATED APPLICATION

This application claims the benefit of U.S. Provisional Patent Application No. 61/464,868 filed Mar. 10, 2011, the contents of which are hereby incorporated by reference.

TECHNICAL FIELD

This description relates generally to an oil system for engines and more specifically to diesel engines and, diesel engines including an aftermarket accessory system for bypassing oil around the oil cooler until a desired operating oil temperature has been achieved

BACKGROUND

Diesel or compression ignition engines experience various operational difficulties in cold or sub zero temperatures. Hard starting can be a common problem caused by various mechanisms. The hard starting problem exists with mobile engines such as those in large trucks, buses and even smaller trucks such as the 6.0L and 6.4L engines manufactured by FORD® and those of other vehicle manufacturers. Engines for fixed installations often also encounter the similar difficulties in starting in cold weather.

Typical hard starting mechanisms include reduced battery currents at low temperatures, decreasing the electrical power available to start the engine. Improper atomization of fuel in the cylinder makes it harder to mix the fuel with the air to achieve combustion. This is typically caused by the injected fuel failing to atomize, because it is condensing on the cylinder surface. Also at cold temperatures the lubricating oil covering various surfaces tends to thicken to the point that increased resistance to cranking the engine can be experienced, often further taxing a battery that may be operating at a reduced output.

Various systems and devices that may be utilized to improve starting in cold weather can include battery heaters (to produce higher battery output), engine block heaters (to reduce oil viscosity, and reduce fuel condensation), glow plugs (installed in the cylinder to prevent fuel condensation) and the like.

Proper lubrication can also be a problem in cold weather operation. The cold diesel fuel injected into the cold cylinders can condense, and passes along the cylinder walls, diluting the lubricating oil.

In addition to the difficulty of cold starting, lubrication in cold weather operation can also be a problem. The engine lubricating oil becomes more viscous in cold temperatures, reducing its effectiveness in lubricating engine components during startup and initial operation. Some operators elect to use an oil such as an exemplary OW-20 to allow for easier cold weather starting. However, once the engine is warmed, the oil film thickness in bearing surfaces may drop below that recommended by manufacturers. Thus, another problem operators of diesel engines encounter during cold weather operation is to select an oil that will adequately lubricate and will not contribute to starting difficulties.

Since diesel engine's operate in all seasons hot weather operation is a consideration in their design as well. To aid hot weather operation, diesel engines are often equipped with engine oil coolers that tend to reduce oil temperature during hot driving conditions, and to keep the oil at a proper viscosity level (because of its temperature) to properly lubricate the engine. However, engine oil coolers do not aid engine operation in cold environments where it is often desirable to warm the oil, not take heat out of it. If engines having an oil cooler could be fitted with a device to aid cold weather starting and operation then the useful temperature range of a diesel engine and its performance might be improved.

And in cold weather there also exists a need for a lubricating oil system for diesel engines that will enhance starting capability and allow users to select a grade of oil which will provide adequate lubrication.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

Briefly, the present example provides a diesel engine oil system intended for cold weather operation which filters the oil and has an oil cooler for cooling the oil. The system has a bypass module which includes both a pressure bypass element and a thermostatic bypass element which operate independently of one another. The system has several configurations. In one configuration, oil from the engine, after passing through a filter, can be directed to a tee fitting which has one branch coupled to an oil cooler and another branch coupled to the bypass module. If the oil temperature is below a preset temperature (about 180 F), the thermostatic element will be open allowing high pressure oil to proportionately bypass the cooler, directing the oil to return to the engine.

In an alternate configuration, oil from the engine may also be introduced to the bypass module at another port if required by the installation environment. In this configuration, oil either is directed to the cooler or to the return oil engine circuit, depending on the position of the thermostatic element in the bypass module.

In addition to a thermal bypass valve for directing oil around the oil cooler when the oil temperature is below a preset level, the bypass module or block may include a pressure bypass element. This element opens at a preset pressure differential between the oil supply and the oil return oil to the engine. Should the return oil pressure drop or the supply pressure increase resulting in a pressure differential above a preset threshold level, the pressure element will direct oil to flow to the return oil line. When the pressure differential is below the threshold value, the pressure element will close, directing oil to the oil cooler.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe an engine oil system for engines operating in a cold environment. Although the present examples are described and illustrated herein as being implemented in a diesel engine system, the system described is provided as an example and not a limitation. As those skilled in the art will appreciate, the present examples are suitable for application in a variety of different types of oil systems.

Figure 1:
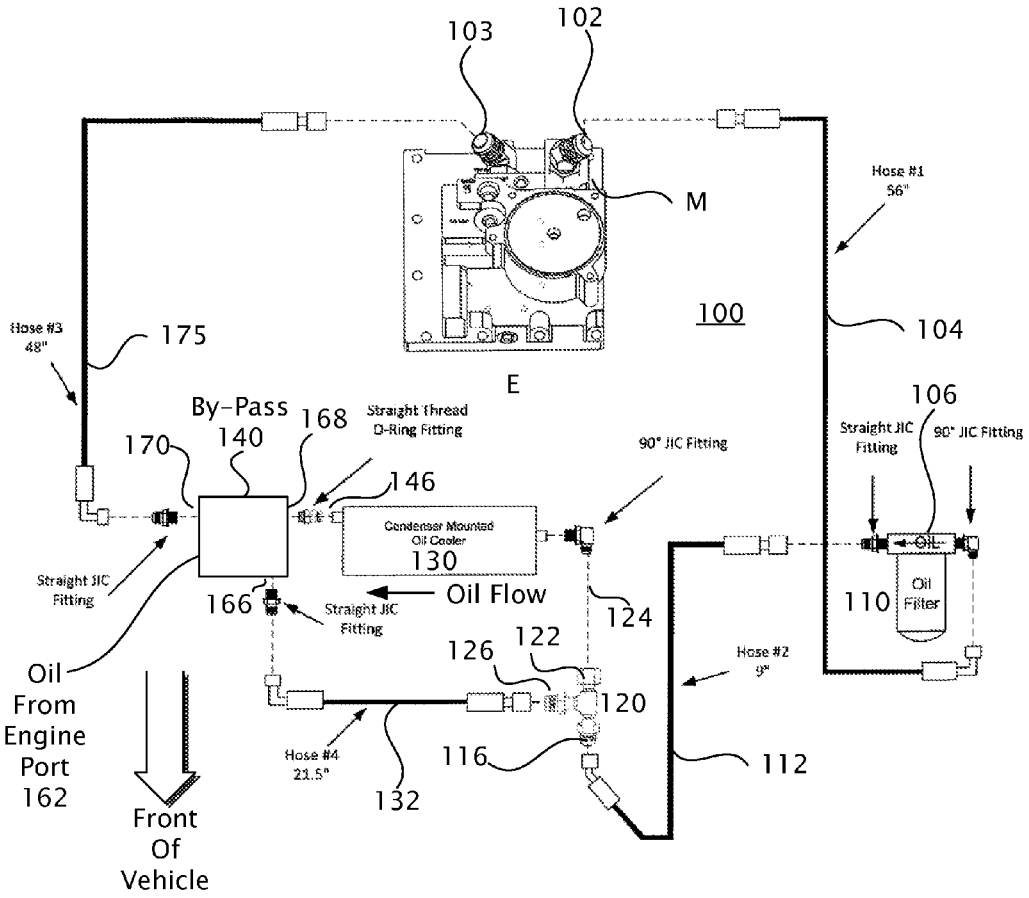
FIG. 1 is a schematic diagram of the cold weather lubrication system of the present invention.

FIG. 1 is a schematic diagram of the cold weather lubrication system of the present example. The system of the present example is generally designated by the numeral 100 and may be an OEM or stock system or may be a retrofit aftermarket modification to an existing engine. The hose lengths provided and fittings shown are exemplary, and not meant to be limiting in any way. The engine E has an oil distribution manifold M which is normally mounted to the top of the engine. The manifold M has an outlet 102 for oil which is pumped from the engine through the manifold by the original equipment manufacturer ("OEM") low pressure oil pump (not shown).

The oil may be directed by line 104 to the base 106 of oil filter 110. Oil filter 110 is shown as a cartridge style filter, or its equivalent, which screws on to the conventionally constructed base 106. Oil passes through the media within the cartridge and the filtered oil can be discharged through line 112. The oil filter may be located in any convenient location in the engine compartment, or external to it.

Line 112 connects to inlet 116 of tee fitting 120. Tee 120 has an outlet 122 coupled by line 124 to the inlet of conventionally constructed oil cooler 130. The other outlet, or branch, 126 of tee 120 may be coupled by line 132 to the bypass block or module 140 at bypass module block port 166. Bypass block 140 can be specially constructed to operate based on operating parameters of the oil supply such as temperature and/or pressure.

The oil cooler 130 is often a liquid-to-air cooler having finned tubes through which oil passes to the outlet 146 of the heat exchanger. The heat exchanger cools the oil in heat exchange relationship with air which passes across the exterior of the finned tubes. The oil cooler may be located in any suitable location where it can be subject to adequate airflow for cooling. A convenient location is to secure the cooler to the condenser unit using suitable mounting brackets. The present example provides a system which allows use of an air-to-liquid cooler even in cold environments. The bypass module port 168 may be coupled to the outlet 146 of the cooler. Bypass module port 17 may be coupled via line 175, to manifold port 103.

Figure 2:
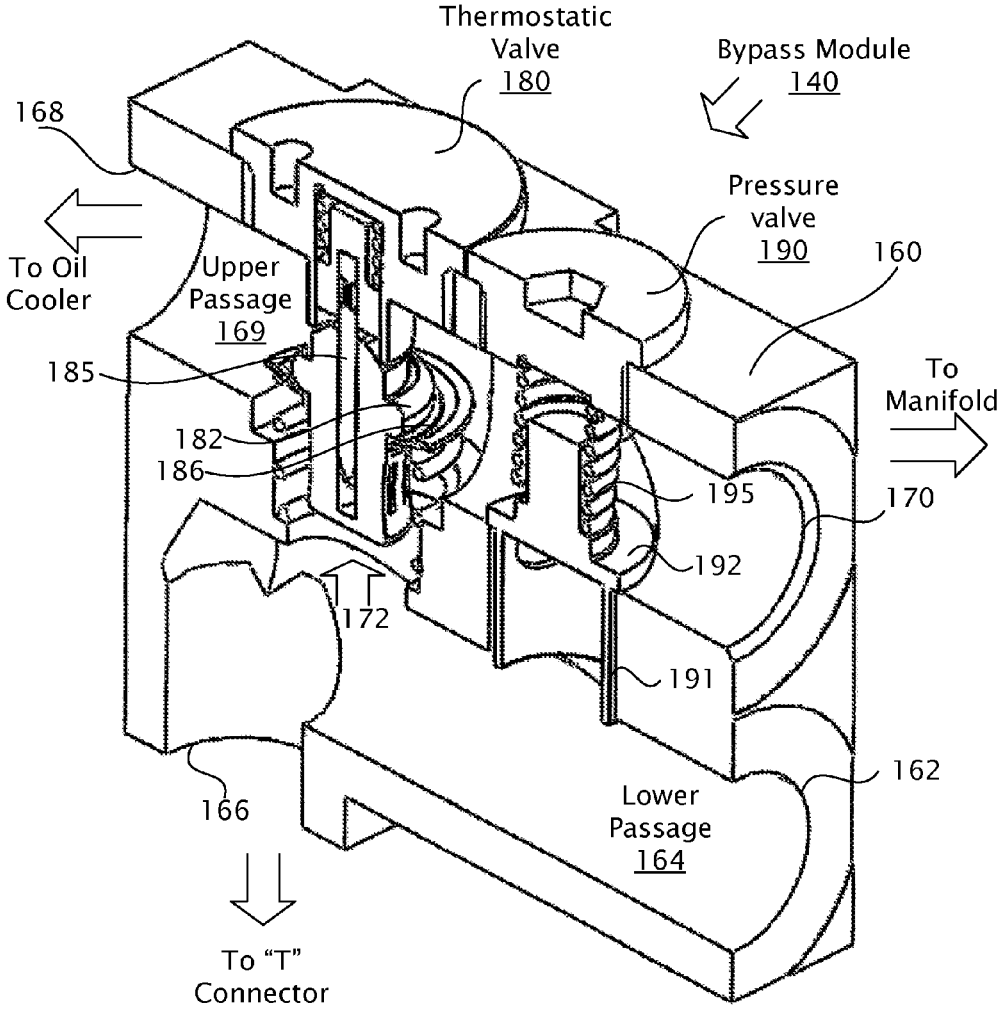
FIG. 2 is a cut-away perspective view of the bypass module showing the various ports and the temperatures and pressure bypass valve element.

FIG. 2 is a cut-away perspective view of the bypass module showing the various ports and the temperatures and pressure bypass valve element. The bypass module 140 has a body 160 of aluminum or other suitable material. Lower passage 164 extends with the body and may be intercepted at its blind end by threaded port 166. For simplicity threads are not shown. Alternatively connections equivalent to threaded connections may be provided.

Module 140 may include an auxiliry port 162 threaded to receive a fitting for connection for oil from the engine in one installation configuration as will be explained with reference to a second configuration of the bypass module shown in FIG. 4. If port 162 is not used, it will be blocked by a threaded plug, or its equivilent.

An upper passage 169 extends in the upper portion of the bypass module, parallel to lower passage 164, having a threaded port 170 for connection to oil return line (175 of FIG. 1) for returning oil to the engine via the manifold (M of FIG. 1). Oil from the cooler (130 of FIG. 1) may be coupled to the passage 169 at port 168. The upper passage 169 and lower passage 164 are coupled via a pressure switch 190 and a temperature valve 180. Temperature switch (or valve) 180 may be continuously variable in their operation and do not have a hard "on" or hard "off" position engaging in response to a trigger event. The pressure switch (or valve) 190 however, triggers at a preset pressure to open/close as desired.

A first vertical passage 172 extends between the upper and lower parallel passageways 164, 169. The passage 172 may be threaded to receive a thermostatic element 180. Thermostatic element operates to open a path from the upper to lower passage when a designed temperature is reached. The exemplary thermostatic valve element has a sealed chamber 182 which contains a material, such as a wax pellet, which will melt and expands as heated by the oil. Alternatively other thermostatic valve constructions may be provided. A rod 185 operates a valve member 186 in the passageway. Initially the thermostat is open, or is partially open, when the oil temperature in the module is below a preset threshold, as for example 180 degrees Fahrenheit, allowing some or all of the oil flow will be bypassed around the cooler to return to the engine at port 170. The thermostatic element stays open until the oil temperature reaches the nominal thermostat opening temperature.

Thereafter, the thermostat element will dynamically adjust to progressively close in response to changes in oil temperatures, increasing flow to the cooler 130 as the oil temperature rises above the optimum preset temperature. If the temperature of the oil again decreases below the preset limit, the thermostatic element will open proportionately to allow oil to bypass the cooler, thus maintaining a minimum operational oil temperature.

In addition to the temperature element, the bypass module also includes a pressure bypass element 190, shown as a cartridge-style valve, extending in the passage 191 between the lower passage 164 which receives oil from the engine (supply oil) and upper passage 168 in which the pressure is return pressure. If the return oil pressure in passage 170 drops or the supply pressure in passage 164 increases, the pressure element 190 will be subjected to an increased pressure differential, causing the valve flow control member 192 to open and direct high pressure oil to the return line via passage 191. When the pressure differential across the pressure element is below the threshold valve required to open the pressure element, the element is closed, blocking flow between passages 164 and 168.

The pressure element 190 has a flow control member 192 seated in the opening between the passages 164 and 168.

Spring 195 exerts a predetermined downward biasing force on the flow control member 192, maintaining the element closed until a predetermined pressure differential occurs which may be sufficient to overcome the spring bias. This assures a constant flow of oil to the engine in extreme operating conditions such as racing or in sub-freezing conditions. In alternative examples electronic sensing components may be used to sense pressure and temperature and operate electronically controlled valves.

Figure 3:
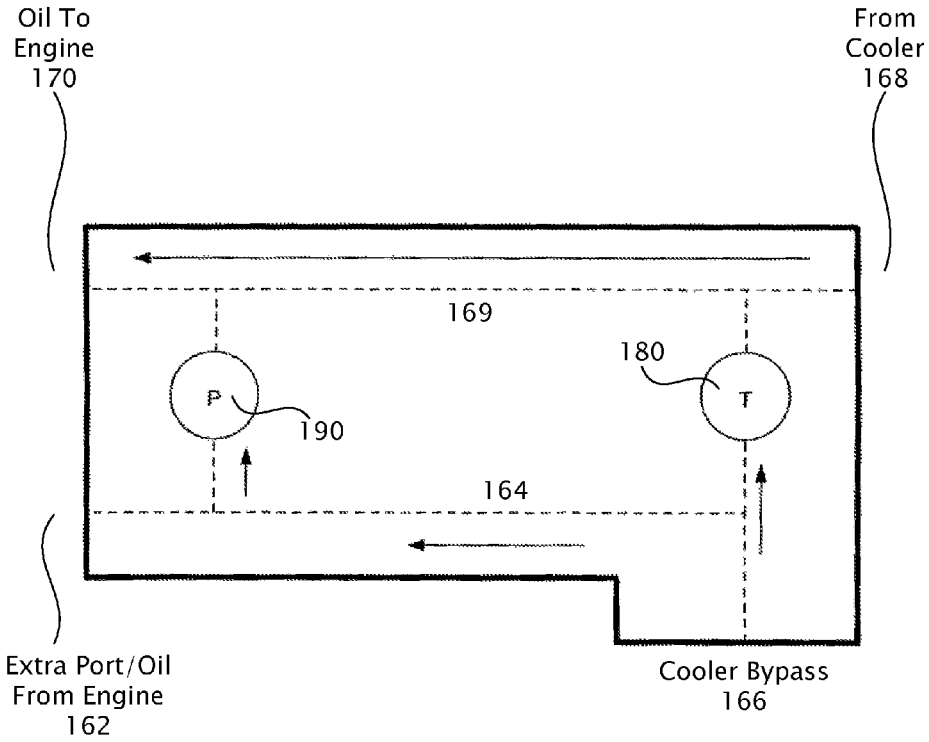
FIG. 3 illustrates the oil flow through the bypass module in one operational configuration of the present system.

FIG. 3 illustrates the oil flow through the bypass module in one operational configuration of the present system. The thermostatic pressure elements 180 and 190, as described above, are also represented by the letters P and T. The cooler bypass port 166 may be coupled to branch 126 of tee 120. The cooler outlet may be coupled to port 168 at one end of passage 169. The opposite end of passage 169 has a port 170 for return oil to the engine.

In operation, oil from the engine, after filtration, enters the inlet 116 of tee 120, upstream of the cooler 130. If the oil is cold, below a preset temperature, thermostatic bypass element 180 will be open allowing oil to flow through passage 169, circumventing the oil cooler, and exiting port 170 to return to the engine. Once the oil reaches a selected temperature, typically about 180 F, then temperature element 180 will close, blocking the bypass channel and forcing the oil through the cooler, into the bypass module 140 at port 168, through passageway 169 to the return oil line 175.

Figure 4:
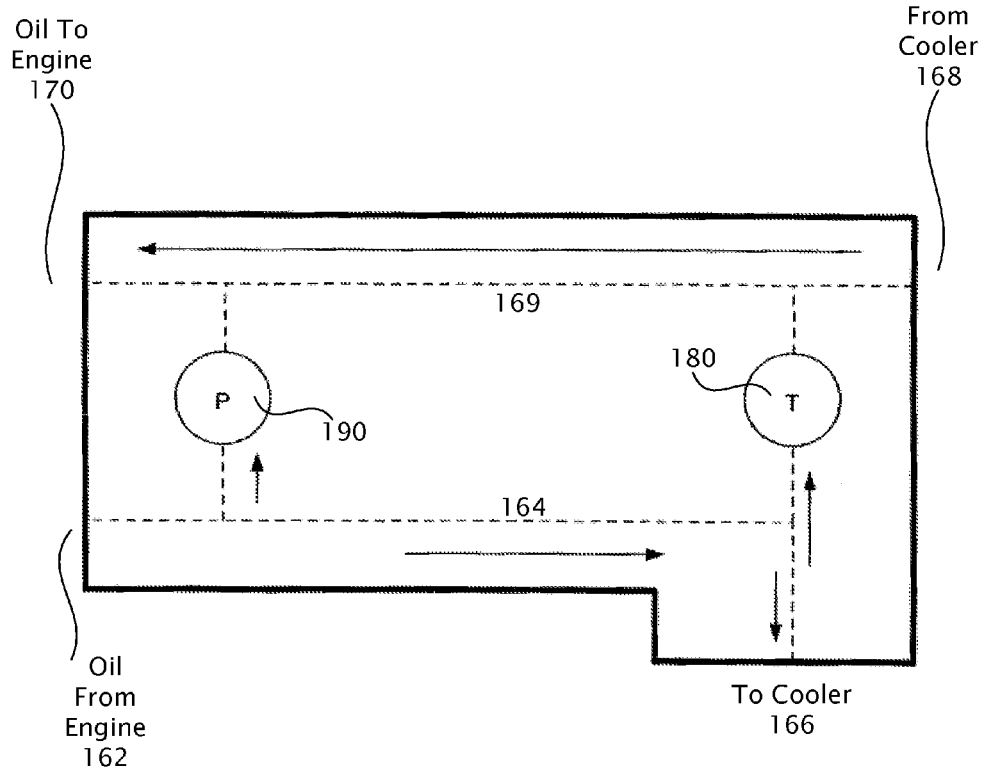
FIG. 4 illustrates the oil flow through the bypass module in another operational configuration.

FIG. 4 illustrates the oil flow through the bypass module in another operational configuration. This port may be utilized in installations where engine configurations and obstructions make it more convenient for connection and routing of oil lines to this location. In this installation, oil flows into the bypass module. Again, the bypass elements 180, 190 are indicated by the letters P and T. Inlet port 162 may be coupled to receive oil from the engine. If both bypass elements 180 and 190 are closed, oil flows out through the port 166 and may be directed through loop 132 to the inlet of cooler 130. Cold oil returns via the "from cooler" port 168 and travels through the module to the return engine oil circuit at port 170.

The bypass elements 180 and 190 are independent working, as described, and will proportionately close to block bypass flow or open proportionately to allow a certain flow of oil to bypass the cooler.

The modification or retrofit for installing the system generally involves removing the A/C condenser and the oil cooler. The bypass module 140 may be attached or coupled to the oil cooler using suitable brackets if necessary. The oil lines are coupled and the condenser reinstalled, removing any interfering structure.

Figure 5:
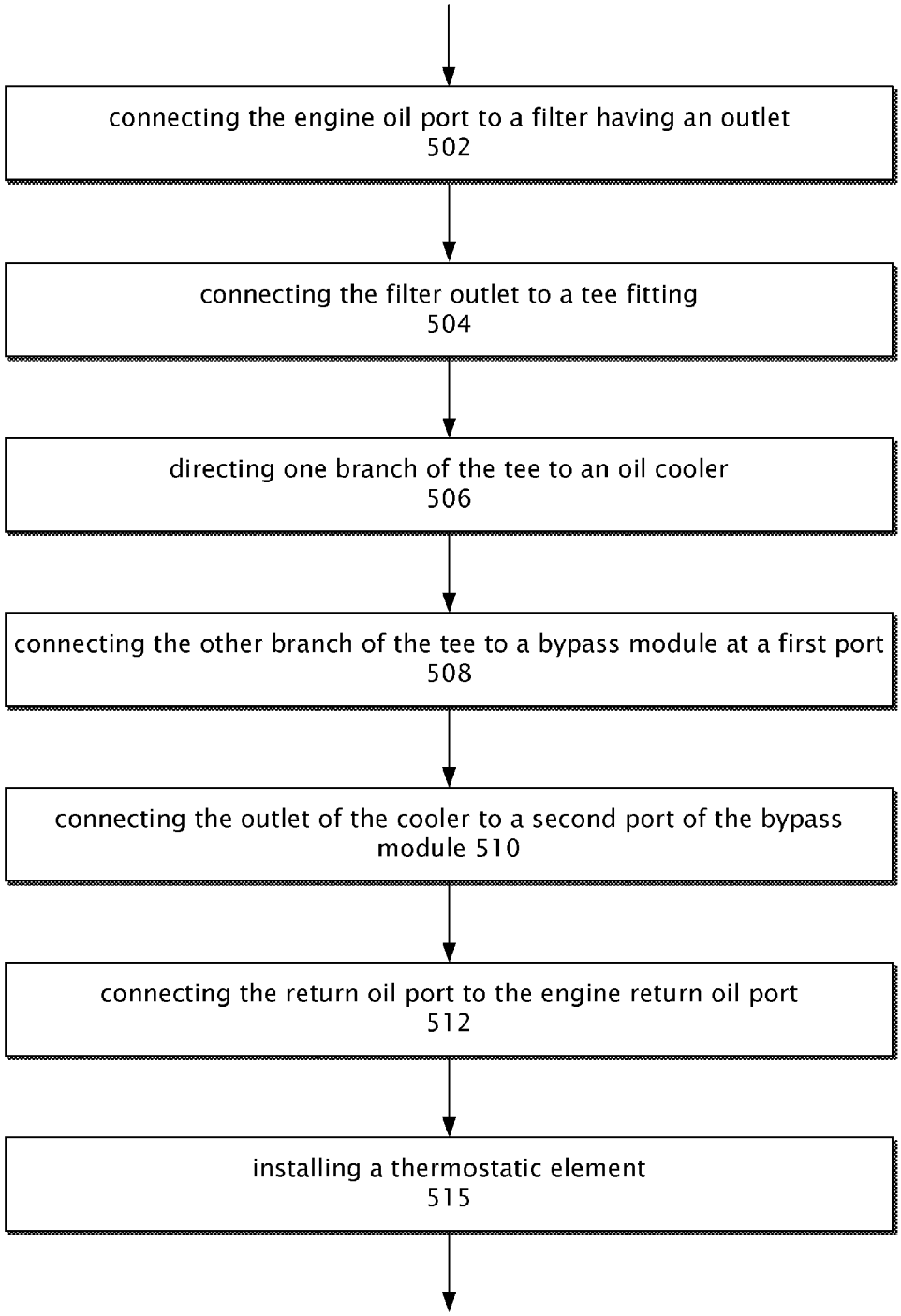
FIG. 5 shows a process for modifying a diesel engine for cold weather operation.

FIG. 5 shows a process for modifying a diesel engine for cold weather operation. At block 502 connecting the engine oil port to a filter having an outlet may be performed. At block 504 connecting the filter outlet to a tee fitting may be performed. At block 506 directing one branch of the tee to an oil cooler may be performed. At block 508 connecting the other branch of the tee to a bypass module at a first port may be performed. At block 510 connecting the outlet of the cooler to a second port of the bypass module, said second port communicating via a passageway with a return oil port may be performed. At block 512 connecting the return oil port to the engine return oil port may be performed. And at block 515 installing a thermostatic element which operates to direct oil to the return port of the oil temperature may be below a preset level and which, when closed, directs oil to the cooler before being directed to the return port may be performed.

It will be obvious to those skilled in the art to make various changes, alterations and modifications to the example described herein. To the extent such changes, alterations and modifications do not depart from the spirit and scope of the appended claims, they are intended to be encompassed therein.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A method of modifying a diesel engine for cold weather operation, said engine having a manifold having engine oil and return oil ports, said method comprising:

connecting the engine oil port to a filter having an outlet;

connecting the filter outlet to a tee fitting;

directing one branch of the tee to an oil cooler;

connecting the other branch of the tee to a bypass module at a first port;

connecting the outlet of the cooler to a second port of the bypass module, said second port communicating via a passageway with a return oil port;

connecting the return oil port to the engine return oil port; and installing a thermostatic element which operates to direct oil to the return port if the oil temperature is below a preset level and which, when closed, directs oil to the cooler before being directed to the return port.

2. The method of claim 1 including step of installing a pressure bypass element in the module which responds to open and direct oil to the engine oil return if the pressure differential between the supply oil and return oil exceeds a preset pressure limit.

* * * * *